US005472625A

United States Patent [19]

Maples

[11] Patent Number: 5,472,625

[45] Date of Patent: Dec. 5, 1995

[54] DRY HOUSEHOLD LUBRICANT

[76] Inventor: Paul D. Maples, 3198 Beachbomber Dr., Morro Bay, Calif. 93442

[21] Appl. No.: 209,217

[22] Filed: Mar. 11, 1994

[51] Int. Cl.[6] ..... C10M 105/04; C10M 105/06

[52] U.S. Cl. ..... 252/39; 252/36; 252/38; 252/41

[58] Field of Search ..... 252/36, 38, 39

[56] References Cited

U.S. PATENT DOCUMENTS

| | | | |
|---|---|---|---|
| 1,694,148 | 12/1928 | Spalding | 252/39 |
| 1,920,202 | 8/1933 | Lange et al. | 87/9 |
| 1,935,588 | 11/1933 | Cabot | 87/9 |
| 1,953,904 | 4/1934 | Bowyer et al. | 102/12 |
| 2,386,553 | 10/1945 | Hilliker | 252/36 |
| 2,393,797 | 1/1946 | Morgan | 252/36 |
| 2,444,357 | 6/1948 | Maguire | 252/36 |
| 3,201,361 | 8/1965 | Patterson | 252/36 X |
| 3,692,678 | 9/1972 | Stiffler | 252/37 |
| 4,260,500 | 4/1981 | Forsberg | 252/39 |

*Primary Examiner*—Prince Willis, Jr.
*Assistant Examiner*—Cephia D. Toomer
*Attorney, Agent, or Firm*—Henri J. A. Charmasson; John D. Buchaca

[57] ABSTRACT

A light-duty, multi-purpose lubricant particularly formulated for use on the diverse bearing surfaces of a bicycle chain and other similar low-speed and low-temperature mechanisms operating in a dusty environment. The lubricant comprises an insoluble soap, preferably Calcium Stearate in suspension in a volatile solvent-based solution of paraffin wax and Petrolatum. After application and evaporation of the solvent the composite dry lubricant exhibits good penetration and load bearing properties without the dirt-retaining character of greases. The undissolved particles of soap combine with dirt particles to break-down portions of the lubricant into a dry flaky dust which is sloughed off the mechanism.

9 Claims, No Drawings

DRY HOUSEHOLD LUBRICANT

FIELD OF THE INVENTION

This invention relates to lubricants, and more particularly to the lubrication of bicycle chains.

BACKGROUND OF THE INVENTION

A bicycle chain is a complex structure that incorporates different mechanisms with specific and often contradictory lubrication requirements.

In the first place, a bicycle chain operates in a very dusty environment. Accordingly, its lubricant should be non-tacky, that is dry or of a low viscosity. This requirement would normally exclude greases in favor of solid lubricants. Indeed, any mineral dust collected by a tacky lubricant will eventually cause abrasion and rapid wear of bearing surfaces. The low pressure, low velocity and limited intermittent frictional movement between the lateral link plates of the chain can be adequately lubricated with a solid or thin film lubricant of a type having a molecule with marked polar activity such as one with a long carbon chain (e.g., Palmitic or Oleic Acid) terminated by an unsaturated carboxyl group (e.g., $CO_2H$), or an unsaturated hydrocarbon distillate. However, the unbalanced and relatively high forces applied by the rollers of the chain against their cross axis call for a grease-type lubricant. Moreover, the shearing contact between the teeth of the driving sprockets and the outside surface of the beads can benefit from the bearing pressure provided by a grease as well as an adsorbed layer of a thin-film lubricant.

A practical, if not efficient, compromise practiced in the prior art consists of lubricating the bicycle chain by dipping it in melted paraffin, wiping the excess lubricant with a rag, then letting the paraffin solidify into a non-tacky film. This approach has some serious limitations, the most obvious being the fact that the chain can only be serviced when off the bicycle. More significant, however, are the facts that paraffin has a poor water tolerance and can disintegrate into flakes when contacted by a small amount of moisture, and, second does not provide a very effective lubricant for the internal and external surface of the rollers and their axles which are subject to both high pressures and shearing forces. Accordingly, there is a need for a multi-functional lubricant specifically formulated for use on bicycle chains and similar mechanisms operating in dusty environments under low speeds, low temperatures, and uneven stresses.

SUMMARY OF THE INVENTION

The principal and secondary objects of this invention are to provide a dry, light duty, water-repellent, and environmentally safe lubricant for use on bicycle chains and similar low-speed and low-temperature mechanisms exposed to dirt particles, including kitchen and garden appliances; particularly a lubricant that will not attract or retain dirt particles, but will instead slough them off the mechanism while exhibiting good penetration and loading of bearing surfaces.

These and other valuable objects are achieved by an insoluble soap dispersed in a volatile solvent-based solution of wax and Petrolatum. After evaporation of the solvent, the mixture of wax and Petrolatum provide a good penetrating and metal-healing protective film. Any import of dirt particles combine with the insoluble soap particles to breakdown the bond between some of the wax and Petrolatum.

Thus forming dirt-carrying flakes that fall off the mechanism.

DESCRIPTION OF THE PREFERRED EMBODIMENT OF THE INVENTION

The preferred embodiment of the invention addresses the various requirements of an effective lubricant for bicycle chains and other similar mechanisms by combining three different types of anti-wear and anti-friction elements. These elements are combined with a volatile solvent for ease of application, and to form a thin, penetrating multi-functional film over the entire mechanism.

The first component is a soluble wax having a melting point between 45 and 55 degrees Celsius (113° F.–131° F.). A paraffin wax with a melting point of about 46 degrees Celsius (116° F.) from 10 to 30 percent per total weight is preferred because of its high solubility in hydrocarbon solvents. In its solid state, paraffin forms a good bearing lubricant without the dirt-gathering character of greases. Besides paraffin waxes, microcrystalline, hydrogenated triglycerides, synthetic spermaceti, and natural or synthetic waxes with similar melting point characteristics could be used, albeit at a higher cost.

The second component consists of 2 to 9 percent per weight of a hydrocarbon lubricant, preferably petroleum jelly, or a 10 to 30 weight lubricating oil to provide a penetrating lubricant as well as an adsorbable metal-healing film. The relatively low concentration of hydrocarbon lubricant does not substantially increase the viscosity of the end product. The ability of these hydrocarbon lubricants to be partially adsorbed by the metallic surface is believed to be a necessary compliment to the load-bearing characteristic of the wax element.

These two first elements are dissolved in a volatile solvent preferably selected from a group of straight-chain hydrocarbons having from 5 to 8 carbon atoms, and boiling points between 35 and 110 degrees Celsius (95° F.–230° F.). The solvent may be selected from aromatics such as Toluene and Xylene or from chlorinated hydrocarbon solvents such as Perchloroethylene, as well as Naphthas, Pentane and Hexane. The toxicity of Toluene and Perchloroethelene make them unavailable for certain applications. Pentane with a boiling point of 35.5 degrees Celsius is difficult to store and handle under most ambient conditions. Hexane, because of its low cost, low toxicity and high solubility is the preferred choice. The solvent is simply a carrier which vaporizes shortly after application of the lubricant, and is therefore not considered to be one of its basic components.

The most important component of the lubricant is 5 to 15.5 percent per total weight of a water-repellent salt from the reaction of a fatty acid preferably selected from a group of Stearic, Oleic, Linoleic, or Palmitic acids, with a heavy (Group II and above on the periodic table) metal, preferably selected from a group consisting of Aluminum, Barium, Calcium, Lithium, Magnesium, and Zinc. All the metallic soaps such as Naphthenate and Laurates, although not tested, are expected to be adequate. Calcium Stearate appears to be the most economical and practical choice.

This type of insoluble soap, just like a calcium-based grease, is an excellent dry lubricant on its own right under low temperature conditions. It can provide solid loading and extend the working life of the lubricant, but maintains a relatively low viscosity. The finally divided particles of unsoluble soap suspended in the solution provide a large surface area of adhesion for the other lubricant without becoming greasy, thus maintaining the dry, water and dirt-repelling character of the lubricant.

Most important, however, is the fact that the insoluble soap component was found to provide a self-cleaning effect. In its finally divided form, the soap weakens the cohesive bond of the wax and oil components. The bonds between, for example, paraffin and Petrolatum are so weakened by contact with the soap that the introduction of a small amount of additional material such as dust or dirt will cause the integrity of part of the solid lubricant to disintegrate into small particles that flake away from the unaffected part of the lubricant. In that process, the bulk of the dust or dirt is sloughed away. The above-described phenomenon insures that even the most inaccessible areas of the lubricated surfaces are maintained in absolutely clean condition.

EXAMPLE 1

15.5 percent per total weight of Calcium Stearate are dispersed in a solution of 7 percent of total weight of Petrolatum (petroleum jelly) and 20 per percent of total weight of a paraffin having a melting point of 46.6 degrees Celsius (116° F.) with 57.5 percent per total weight of Hexane. After thorough mixing, the formulation was applied to all areas of a bicycle chain, and the excess wiped off with a rag. The formulation was allowed to dry to a solid, non-tacky film.

EXAMPLE 2

14 percent per total weight of Aluminum Stearate dispersed in a solution of 5 percent per total weight of 10 weight petroleum distillate lubricating oil, and 16 percent per total weight of paraffin with a melting point of 74 degrees Celsius (135° F.) dissolved in 65 percent per weight of Perchloroethelene.

EXAMPLE 3

15 percent per total weight of Calcium Oleate suspended in a solution of 6 percent per total weight of a 30 weight motor oil and 18 percent per total weight of a paraffin with a melting point of 52 decrees Celsius (125° F.) with a mixture of 25 percent per total weight of Toluene and 36 percent per total weight of Varnish Makers and Paints grade of Naptha.

While the preferred embodiment of the invention has been described, modifications can be made and other embodiments may be devised without departing from the spirit of the invention and the scope of the appended claims.

What is claimed is:

1. A multi-functional, light duty lubricant comprising 5 to 15.5 percent per total weight of an insoluble soap in suspension in a solution of 10 to 30 percent per total weight of a soluble wax having a melting point between 45° C. and 55° C., 2 to 9 percent per total weight of a hydrocarbon lubricant, and 40 to 80 percent per total weight of a volatile solvent, wherein said solvent is selected from a group consisting of straight-chain hydrocarbons having 5 to 8 carbon atoms and boiling points between 35° C. and 110° C., and aromatic hydrocarbons, wherein a bond formed between said wax and said hydrocarbon lubricant is weakened by said soap to a point whereby said bond is breakable by contact of said soap with foreign dust particles.

2. The lubricant of claim 1, wherein said insoluble soap comprises a Stearate of heavy metals selected from a group consisting of Aluminum, Barium, Calcium, Lithium, Magnesium and Zinc.

3. The lubricant of claim 2, wherein said hydrocarbon lubricant is selected from a group consisting of Petrolatum and 10 to 30 weight lubricating oil.

4. The lubricant of claim 3, wherein said wax is selected from a group consisting of paraffin, hydrogenated triglycerides, synthetic spermaceti and natural waxes.

5. The lubricant of claim 4, which comprises:

calcium Stearate in suspension in a solution of paraffin wax, Petrolatum and Hexane.

6. The lubricant of claim 4, which comprises Calcium Oleate in suspension in a solution of paraffin wax, motor oil, Toluene and Varnish Makers and Paints grade of Naphtha.

7. A method for lubricating a bicycle chain which comprises contacting all areas of the chain with a mixture of 5 to 10 percent per total weight of a insoluble soap comprising a Stearate of a heavy metal selected from a group consisting of Aluminum, Barium, Calcium, Lithium, Magnesium and Zinc, in suspension in a solution comprising:

10 to 30 percent per total mixture weight of a wax having a melting point between 45° C. and 55° C.;

2 to 9 percent per total mixture weight of a hydrocarbon lubricant; and 40 to 80 percent per total mixture weight of a volatile solvent; wiping all excess mixture off said chain; and allowing said mixture to dry.

8. The method of claim 7, wherein said step of allowing said mixture to dry comprises:

evaporating said volatile solvent.

9. A multi-functional, light duty lubricant comprising 5 to 15.5 percent per total weight of Aluminum Stearate in suspension in a solution of 10 to 30 percent per total weight of paraffin wax, 2 to 9 percent per total weight of lubricating oil and 40–80 percent per total weight of Perchloroethylene.

* * * * *